US009824630B2

(12) United States Patent
Lai et al.

(10) Patent No.: US 9,824,630 B2
(45) Date of Patent: Nov. 21, 2017

(54) PIXEL UNIT STRUCTURE HAVING A RESET CIRCUIT AND DRIVING MECHANISM OF ORGANIC LIGHT EMITTING DIODE DISPLAY PANEL

(71) Applicant: HON HAI PRECISION INDUSTRY CO., LTD., New Taipei (TW)

(72) Inventors: Chung-Wen Lai, New Taipei (TW); Sheng-Han Li, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 37 days.

(21) Appl. No.: 14/812,291

(22) Filed: Jul. 29, 2015

(65) Prior Publication Data

US 2016/0148573 A1 May 26, 2016

(30) Foreign Application Priority Data

Nov. 26, 2014 (TW) ..... 103141078 A

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/08* (2013.01); *G09G 2320/045* (2013.01)

(58) Field of Classification Search
CPC ..... G09G 3/3233
USPC ..... 345/76, 82
See application file for complete search history.

(56) References Cited

U.S. PATENT DOCUMENTS

| | | | | |
|---|---|---|---|---|
| 9,084,331 | B2 | 7/2015 | Li et al. | |
| 2006/0022305 | A1* | 2/2006 | Yamashita | G09G 3/2014 257/565 |
| 2007/0040772 | A1* | 2/2007 | Kim | G09G 3/3233 345/76 |
| 2009/0140957 | A1* | 6/2009 | Park | G09G 3/3233 345/76 |
| 2010/0141644 | A1* | 6/2010 | Lee | G09G 3/3233 345/214 |
| 2011/0193856 | A1* | 8/2011 | Han | G09G 3/3233 345/214 |
| 2015/0070407 | A1* | 3/2015 | Lee | G09G 3/3233 345/690 |

FOREIGN PATENT DOCUMENTS

| | | | |
|---|---|---|---|
| KR | 10-2007-0081950 | A | 8/2007 |
| TW | 200802282 | A | 1/2008 |
| TW | 201407581 | A | 2/2014 |

* cited by examiner

*Primary Examiner* — Long D Pham
(74) *Attorney, Agent, or Firm* — ScienBiziP, P.C.

(57) ABSTRACT

A pixel unit structure of an organic light emitting diode display panel includes a switch transistor, a storage capacitor, an organic light emitting diode, a driving transistor, a reset circuit, and a control circuit. The organic light emitting diode is controlled by the driving transistor and the control circuit to emit light. The pixel unit operates in a number of time events repeating in sequence.

8 Claims, 6 Drawing Sheets

PIXEL UNIT STRUCTURE HAVING A RESET CIRCUIT AND DRIVING MECHANISM OF ORGANIC LIGHT EMITTING DIODE DISPLAY PANEL

FIELD

The subject matter herein generally relates to organic light emitting diode (OLED) display panels, and more particularly to an OLED pixel unit structure and driving means of the OLED pixel unit.

BACKGROUND

Generally, organic light emitting diodes (OLED) used in OLED display panels are classified as active matrix OLEDs (AMOLEDs) or passive matrix OLEDs (PMOLEDs). AMOLED display panels may include a driving transistor and a storage capacitor. The storage capacitor stores a data signal. The driving transistor provides a driving current to the OLED to emit light according to the data signal stored in the storage capacitor.

BRIEF DESCRIPTION OF THE DRAWINGS

Implementations of the present technology will now be described, by way of example only, with reference to the attached figures.

DETAILED DESCRIPTION

Figure 1:
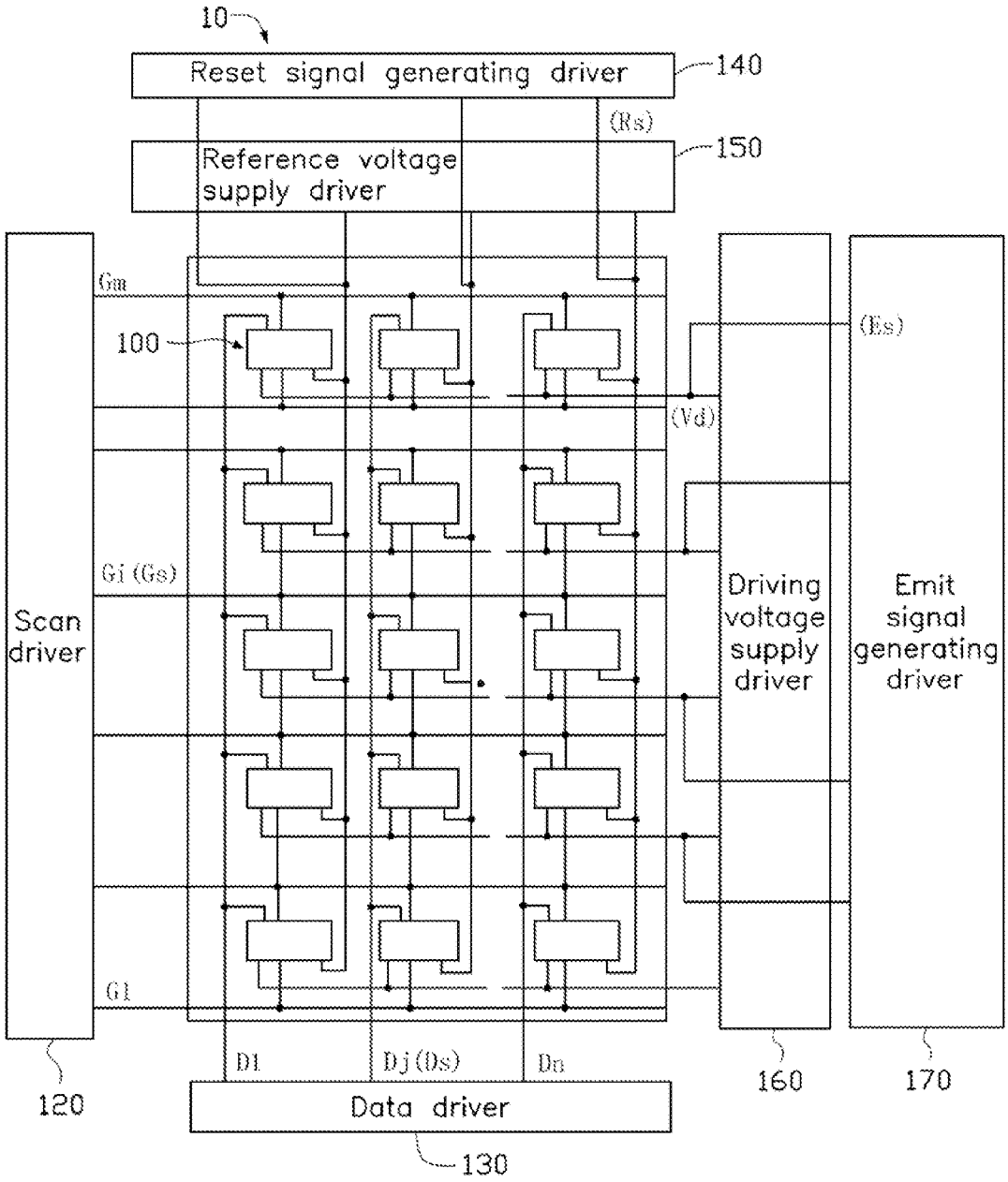
FIG. 1 is a circuit diagram of a first embodiment of an organic light emitting diode display panel.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

FIG. 1 illustrates a first embodiment of a structure of an electronic display panel 10. In at least one embodiment, the electronic display panel 10 is an OLED display panel. The electronic display panel 10 can include a scan driver 120, a data driver 130, a reset signal generating driver 140, a reference voltage supply driver 150, a driving voltage supply driver 160, an emission signal generating driver 170, and a plurality of pixel units 100. Each pixel unit 100 can be electrically coupled to the scan driver 120, the data driver 130, the reset signal generating driver 140, the reference driving voltage supply driver 150, the driving voltage supply driver 160, and the emission signal generating driver 170 to receive corresponding signals to operate in a plurality of time events repeating in sequence.

A plurality of scan lines G1-Gm can extend from the scan driver 120. The scan driver 120 can generate scan signals Gs, and each scan line G1-Gm can transmit the scan signals Gs to corresponding pixel units 100 arranged along the scan line. A plurality of data lines D1-Dn can extend from the data driver 130. The data driver 130 can generate data signals Ds, and each data line D1-Dn can transmit the data signals Ds to corresponding pixel units 100 arranged along the data line. A plurality of reset signal lines (not labeled) can extend from the reset signal generating driver 140. The reset signal generating driver 140 can generate reset signals Rs, and each reset signal line can transmit the reset signals Rs to corresponding pixel units 100 arranged along the reset signal line. A plurality of reference voltage lines (not labeled) can extend from the reference voltage supply driver 150. The reference voltage supply driver 150 can generate a reference voltage Vr (shown in FIG. 2), and each reference voltage line can transmit the reference voltage Vr to corresponding pixel units 100 arranged along the reference voltage line. A plurality of driving voltage lines (not labeled) can extend from the driving voltage supply driver 160. The driving voltage supply driver 160 can generate a driving voltage Vd, and each driving voltage line can transmit the driving voltage Vd to corresponding pixel units 100 arranged along the driving voltage line. A plurality of emission signal lines (not labeled) can extend from the emission signal generating driver 170. The emission signal generating driver 170 can generate emission signals Es, and each emission signal line can transmit the emission signals Es to corresponding pixel units 100 arranged along the emission signal line.

Figure 2:
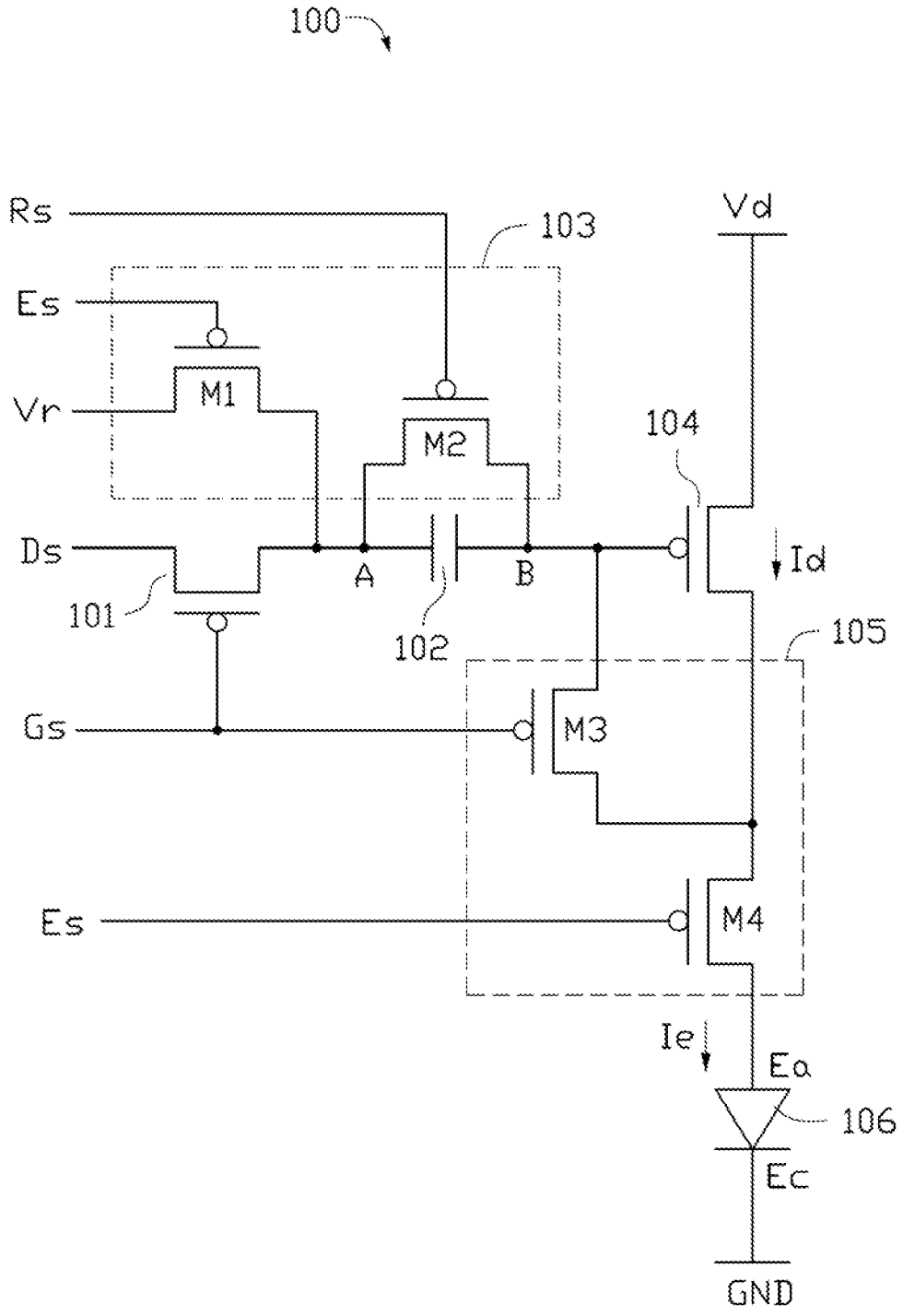
FIG. 2 is a circuit diagram of a pixel unit structure of FIG. 1.

Referring to FIG. 2, each pixel unit 100 can include a switch transistor 101, a storage capacitor 102, a reset circuit 103, a driving transistor 104, a control circuit 105, and an organic light emitting diode (OLED) 106. The switch transistor 101 can be electrically coupled to the corresponding scan line Gi and the corresponding data line Dj to receive the scan signal Gs and the data signal Ds, respectively. The storage capacitor 102 can receive the data signal Ds from the switch transistor 101. The reset circuit 103 can be electrically coupled to the corresponding emission signal line, the corresponding reference voltage line, and the corresponding reset signal line to receive the emission signal Es, the reference voltage Vr, and the reset signal Rs, respectively. The reset circuit 103 can relay the reference voltage Vr to the storage capacitor 102. The driving transistor 104 is electrically coupled to the corresponding driving voltage line to receive the driving voltage Vd and can output a driving current Id to drive the OLED 106 to emit light corresponding to the data signal Ds. The control circuit 105 is electrically coupled to the corresponding scan line and the corresponding emission signal line to receive the scan signal Gs and the emission signal Es, respectively, and can relay the driving current Id to the OLED 106.

The OLED 106 can include an anode terminal Ea and a cathode terminal Ec. The anode terminal Ea can be electrically coupled to the control circuit 105, and the cathode terminal Ec can be electrically coupled to ground Gnd.

A gate electrode of the switch transistor 101 is electrically coupled to the scan line to receive the scan signal Gs. A source electrode of the switch transistor 101 is electrically coupled to the data line to receive the data signal Ds. A drain electrode of the switch transistor 101 is electrically coupled to the storage capacitor 102 to relay the data signal Ds to the storage capacitor 102.

The storage capacitor 102 includes a first connecting terminal A and a second connecting terminal B. The first connecting terminal A is electrically coupled to the drain electrode of the switch transistor 101 to receive the data signal Ds, and the second connecting terminal B is electrically coupled to the driving transistor 104 and the control circuit 105.

The reset circuit 103 includes a first control transistor M1 and a second control transistor M2. A gate electrode of the first control transistor M1 is electrically coupled to the emission signal line to receive the emission signal Es from the emission signal generating driver 107. A source electrode of the first control transistor M1 is electrically coupled to the reference voltage line to receive the reference voltage signal Vr from the reference voltage signal supply driver 150. A drain electrode of the first control transistor M1 is electrically coupled to the first connecting terminal A of the storage capacitor 102. A gate electrode of the second control transistor M2 is electrically coupled to the reset signal line to receive the reset signal Rs from the reset signal generating driver 140. A source electrode of the second control transistor M2 is electrically coupled to the first connecting terminal A. A drain electrode of the second control transistor M2 is electrically coupled to the second connecting terminal B.

A gate electrode of the driving transistor 104 is electrically coupled to the second connecting terminal B of the storage capacitor 102 to receive the data signal Ds. A source electrode of the driving transistor 104 is electrically coupled to the driving voltage line to receive the driving voltage Vd from the driving voltage supply driver 160. A drain electrode of the driving transistor 104 is electrically coupled to the control circuit 105. The data signal Ds controls the driving transistor 104 to be in a conducting state, and the driving transistor 104 in the conducting state is controlled by the driving voltage Vd to output the driving current Id.

The control circuit 105 includes a third control transistor M3 and a fourth control transistor M4. A gate electrode of the third control transistor M3 is electrically coupled to the scan line to receive the scan signal Gs. A source electrode of the third control transistor M3 is electrically coupled to the second connecting terminal B to receive the data signal Ds. A drain electrode of the third control transistor M3 is electrically coupled to the fourth control transistor M4. The third control transistor M3 is controlled by the scan signal Gs to relay the data signal Ds to the fourth control transistor M4. A gate electrode of the fourth control transistor M4 is electrically coupled to the emission signal line to receive the emission signal Es from the emission signal generating driver 170. A source electrode of the fourth control transistor M4 is electrically coupled to the drain electrode of the third control transistor M3 to receive the data signal Ds and receives the driving current Id. A drain electrode of the fourth control transistor M4 is electrically coupled to the OLED 106.

In at least one embodiment, the switch transistor 101, the driving transistor 104, the first control transistor M1, the second control transistor M2, the third control transistor M3, and the fourth control transistor M4 are P-channel metal oxide semiconductors. The switch transistor 101 and the third control transistor M3 are in a conducting state upon receiving the scan signal Gs at a low voltage level, and in a non-conducting state upon receiving the scan signal Gs at a high-voltage level. The second control transistor M2 is in a conducting state upon receiving the reset signal Rs at a low voltage level, and in a non-conducting state upon receiving the reset signal Rs at a high voltage level. The first control transistor M1 and the fourth control transistor M4 are in a conducting state upon receiving the emission signal Es at a low voltage level, and in a non-conducting state upon receiving the emission signal Es at a high voltage level. The scan signal Gs, the reset signal Rs, and the emission signal Es control the pixel unit 100 to operate in a plurality of time events repeating in sequence.

Figure 3:
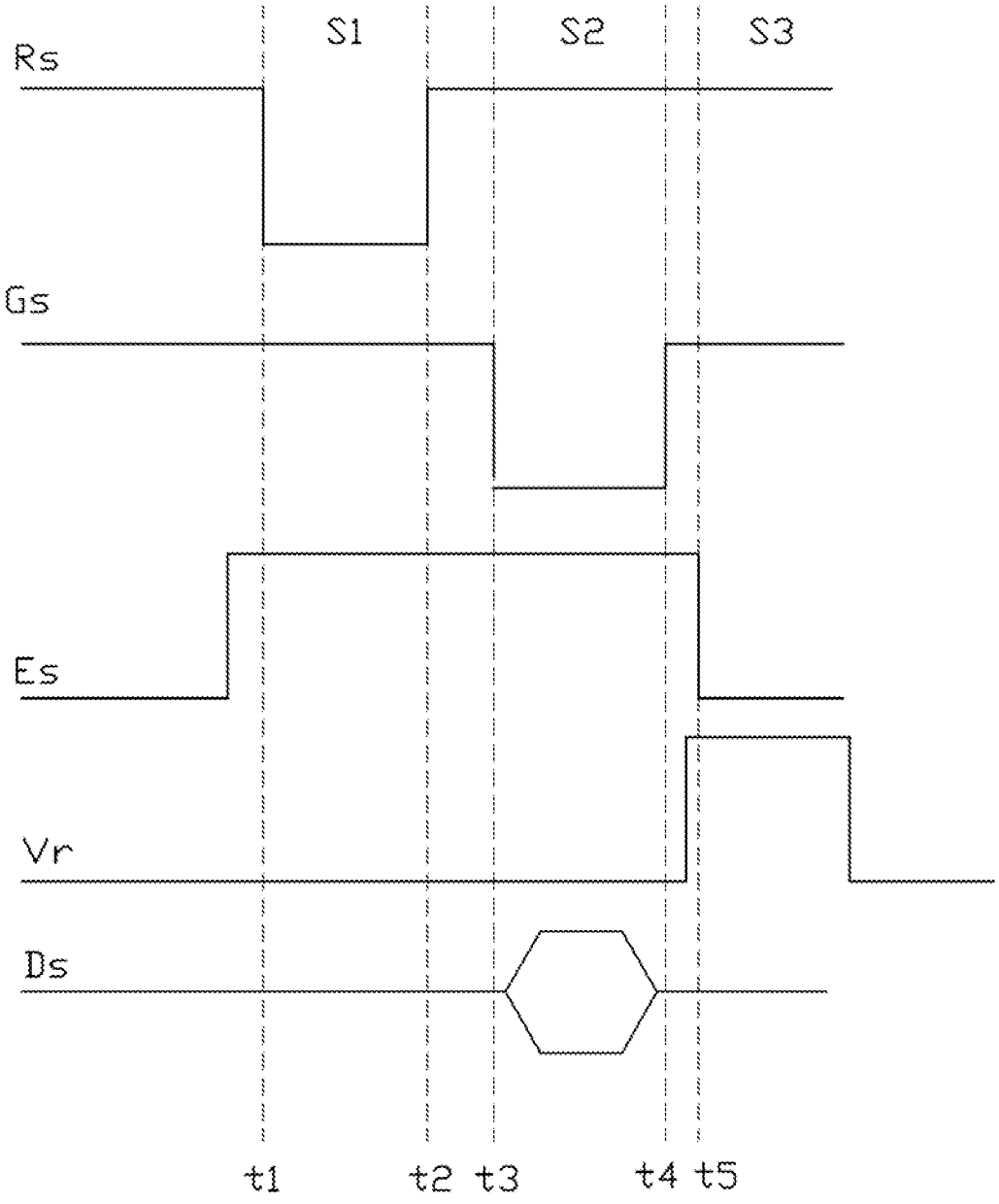
FIG. 3 is a driving sequence diagram of the pixel unit structure of FIG. 2.

Referring to FIG. 3, the plurality of time events of each pixel unit 100 can include five time events.

At a first time event t1, the first control transistor M1 is in the non-conducting state, and the second control transistor receives the reset signal Rs at the low voltage level to be in the conducting state. Thus, the first connecting terminal A is electrically coupled to the second connecting terminal B through the second control transistor M2. A time period between the first time event t1 and a second time event t2 is a discharge event. During the discharge event, electrical charge in the storage capacitor 102 is discharged through a conduction path formed by the first connecting terminal A, the second control transistor M2, and the second connecting terminal B.

At the second time event t2, the second control transistor M2 is controlled by the reset signal Rs to be in the non-conducting state.

At a third time event t3, the switch transistor 101 and the third control transistor M3 receive the scan signal Gs at the low voltage level to be in the conducting state. A time period between the third time event t3 and a fourth time event t4 is a data loading event. During the data loading event, the switch transistor 101 receives the data signal Ds and relays the data signal Ds to the first connecting terminal A to make a voltage of the first connecting terminal A equal to a voltage of the data signal Ds (i.e., Vds). The data signal Ds causes the driving transistor 104 to be in the conducting state. A voltage of the second connecting terminal B is equal to the difference between the driving voltage Vd and a threshold voltage Vth of the driving transistor 104, wherein the difference is Vd−Vth. Thus, a voltage difference between the first connecting terminal A and the second connecting terminal B of the storage capacitor 102 is equal to (Vds−(Vd−Vth)). The threshold voltage Vth is equal to the minimum voltage required for the driving transistor 104 to transition from the non-conducting state to the conducting state.

At the fourth time event t4, the switch transistor 101 and the third control transistor M3 are controlled by the scan signal Gs to be in the non-conducting state. Thus, the data signal Ds is stopped from being transmitted to the switch transistor 101.

At a fifth time event t5, the first control transistor M1 and the fourth control transistor M4 are controlled by the emission signal Es to be in the conducting state. A time period between the fifth time event t5 and the first time event t1 is a display event. During the display event, the first control transistor relays the reference voltage Vr to the first connecting terminal A to make the voltage of the first connecting terminal A equal to the reference voltage Vr. The voltage of the second connecting terminal B is equal to (Vr−(Vds−(Vd−Vth))), or (Vr−Vds+Vd−Vth). The driving transistor 104 is controlled by the voltage of the second connecting terminal B to output the driving current Id. The driving current Id is relayed by the fourth control transistor M4 to the OLED 106, and the OLED 106 emits light corresponding to the data signal Ds upon receiving the driving current Id. A current Ie flowing through the OLED 106 is directly proportional to $(Vsg-Vth)^2$, wherein Vsg represents the voltage difference between the source electrode and the gate electrode of the driving transistor 104. Thus, Vsg is equal to (Vd−(Vr−Vds+Vd−Vth), or (−Vr+Vds+Vth). Thus, the current Ie flowing through the OLED 106 is directly proportional to $(Vds-Vr)^2$.

Figure 4:
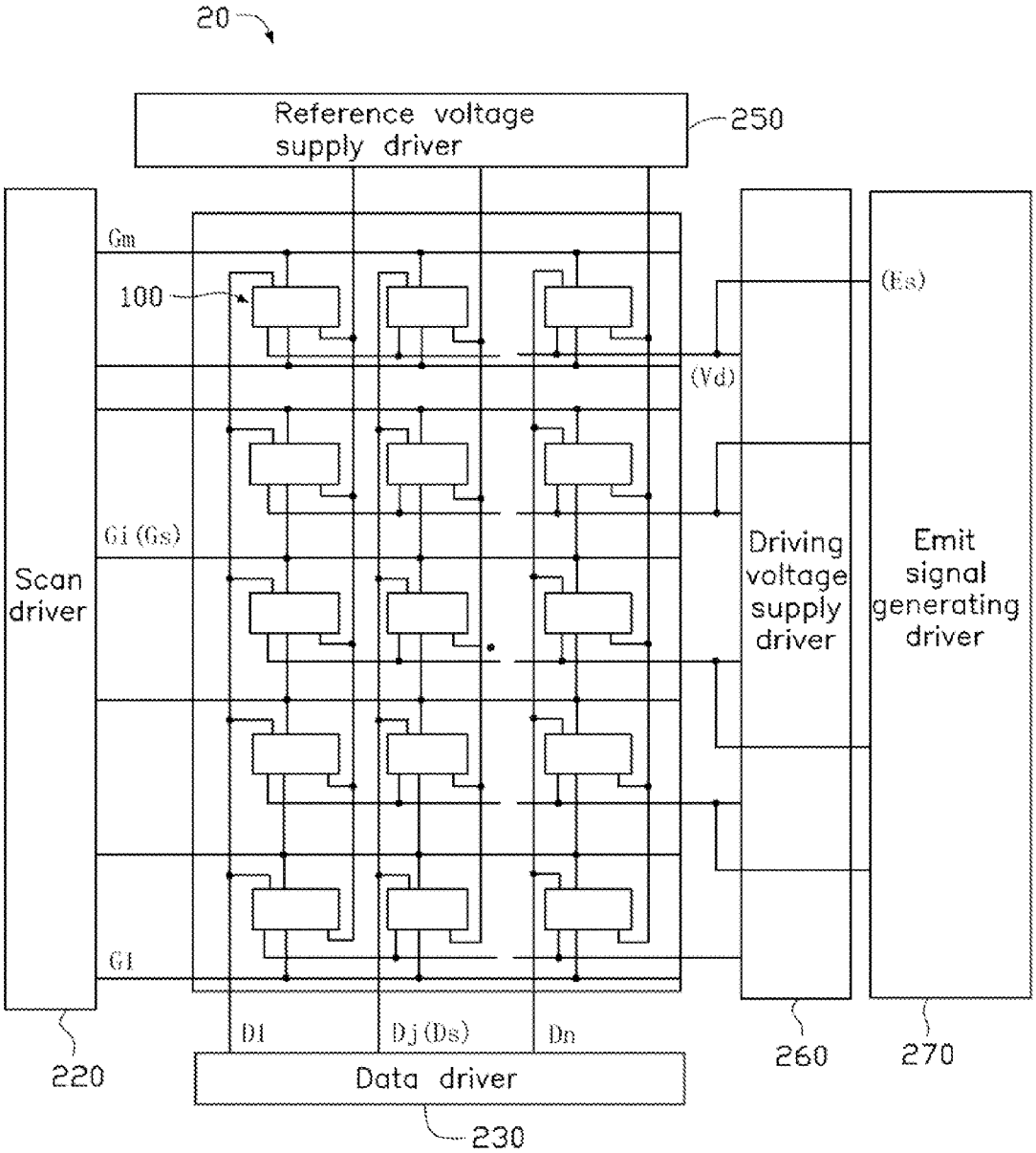
FIG. 4 is a circuit diagram of a second embodiment of an organic light emitting diode display panel.

FIG. 4 illustrates a second embodiment of an electronic display panel 20. In at least one embodiment, the electronic display panel 20 is an organic light emitting diode (OLED) display panel. The electronic display panel 20 can include a scan driver 220, a data driver 230, a reference voltage supply driver 250, a driving voltage supply driver 260, an emission signal generating driver 270, and a plurality of pixel units 100. Each pixel unit 100 can be electrically coupled to the scan driver 220, the data driver 230, the reference voltage supply driver 250, the driving voltage supply driver 260, and the emission signal generating driver 270 to receive corresponding signals to operate in a plurality of time events repeating in sequence.

A plurality of scan lines G1-Gm can extend from the scan driver 220. The scan driver 220 can generate scan signals Gs, and each scan line G1-Gm can transmit the scan signals Gs to corresponding pixel units 100 arranged along the scan line. A plurality of data lines D1-Dn can extend from the data driver 230. The data driver 230 can generate data signals Ds, and each data line D1-Dn can transmit the data signals Ds to corresponding pixel units 100 arranged along the data line. A plurality of reference voltage lines (not labeled) can extend from the reference voltage supply driver 250. The reference voltage supply driver 250 can generate a reference voltage Vr (shown in FIG. 5), and each reference voltage line can transmit the reference voltage Vr to corresponding pixel units 100 arranged along the reference voltage line. A plurality of driving voltage lines (not labeled) can extend from the driving voltage supply driver 260. The driving voltage supply driver 260 can generate a driving voltage Vd, and each driving voltage line can transmit the driving voltage Vd to corresponding pixel units 100 arranged along the driving voltage line. A plurality of emission signal lines (not labeled) can extend from the emission signal generating driver 270. The emission signal generating driver 270 can generate emission signals Es, and each emission signal line can transmit the emission signals Es to corresponding pixel units 100 arranged along the emission signal line.

Figure 5:
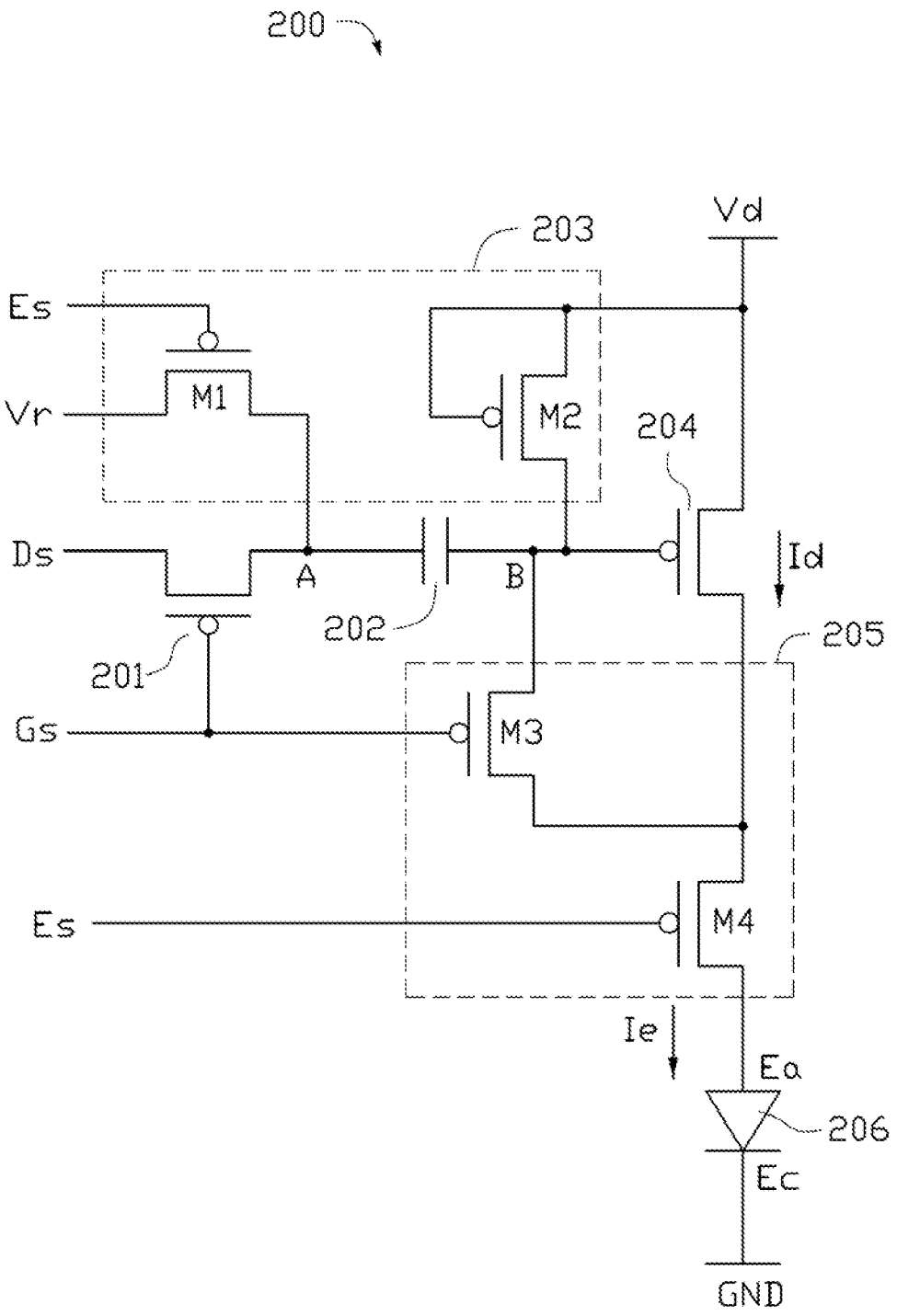
FIG. 5 is a circuit diagram of a pixel unit structure of FIG. 4.

As illustrated in FIG. 5, each pixel unit 100 can include a switch transistor 201, a storage capacitor 202, a reset circuit 203, a driving transistor 204, a control circuit 205, and an organic light emitting diode (OLED) 206. The switch transistor 201 can be electrically coupled to the corresponding scan line Gi and the corresponding data line Dj to receive the scan signal Gs and the data signal Ds, respectively. The storage capacitor 202 can receive the data signal Ds from the switch transistor 201. The reset circuit 203 can be electrically coupled to the corresponding emission signal line and the corresponding reference voltage line to receive the emission signal Es and the reference voltage Vr, respectively. The driving transistor 204 is electrically coupled to the corresponding driving voltage line to receive the driving voltage Vd and can output a driving current Id to drive the OLED 206 to emit light corresponding to the data signal Ds. The control circuit 205 is electrically coupled to the corresponding scan line and the corresponding emission signal line to receive the scan signal Gs and the emission signal Es, respectively, and can relay the driving current Id to the OLED 206.

The OLED 206 can include an anode terminal Ea and a cathode terminal Ec. The anode terminal Ea can be electrically coupled to the control circuit 205, and the cathode terminal Ec can be electrically coupled to ground Gnd.

A gate electrode of the switch transistor 201 is electrically coupled to the scan line to receive the scan signal Gs. A source electrode of the switch transistor 201 is electrically coupled to the data line to receive the data signal Ds. A drain electrode of the switch transistor 201 is electrically coupled to the storage capacitor 202 to relay the data signal Ds to the storage capacitor 202.

The storage capacitor 202 includes a first connecting terminal A and a second connecting terminal B. The first connecting terminal A is electrically coupled to the drain electrode of the switch transistor 201 to receive the data signal Ds, and the second connecting terminal B is electrically coupled to the driving transistor 204 and the control circuit 205.

The reset circuit 203 includes a first control transistor M1 and a second control transistor M2. A gate electrode of the first control transistor M1 is electrically coupled to the emission signal line to receive the emission signal Es from the emission signal generating driver 207. A source electrode of the first control transistor M1 is electrically coupled to the reference voltage line to receive the reference voltage signal Vr from the reference voltage signal supply driver 250. A drain electrode of the first control transistor M1 is electrically coupled to the first connecting terminal A of the storage capacitor 202. A gate electrode of the second control transistor M2 is electrically coupled to the driving voltage line to receive the driving voltage Vd from the driving voltage supply driver 160. A source electrode of the second control transistor M2 is electrically coupled to the second connecting terminal B. A drain electrode of the second control transistor M2 is electrically coupled to the gate electrode of the second control transistor M2.

A gate electrode of the driving transistor 204 is electrically coupled to the second connecting terminal B of the storage capacitor 202 to receive the data signal Ds. A source electrode of the driving transistor 204 is electrically coupled to the driving voltage line to receive the driving voltage Vd from the driving voltage supply driver 160. A drain electrode of the driving transistor 204 is electrically coupled to the control circuit 205. The data signal Ds controls the driving transistor 204 to be in a conducting state, and the driving transistor 204 in the conducting state is controlled by the driving voltage Vd to output the driving current Id.

The control circuit 205 includes a third transistor M3 and a fourth control transistor M4. A gate electrode of the third transistor M3 is electrically coupled to the scan line to receive the scan signal Gs. A source electrode of the third control transistor M3 is electrically coupled to the second connecting terminal B to receive the data signal Ds. A drain electrode of the third control transistor M3 is electrically coupled to the fourth control transistor M4. The third control transistor M3 is controlled by the scan signal Gs to relay the data signal Ds to the fourth control transistor M4. A gate electrode of the fourth control transistor M4 is electrically coupled to the emission signal line to receive the emission signal Es from the emission signal generating driver 270. A source electrode of the fourth control transistor M4 is electrically coupled to the drain electrode of the third control transistor M3 to receive the data signal Ds and receives the driving current Id. A drain electrode of the fourth control transistor M4 is electrically coupled to the OLED 206.

In at least one embodiment, the switch transistor 201, the driving transistor 204, the first control transistor M1, the second control transistor M2, the third control transistor M3, and the fourth control transistor M4 are P-channel metal oxide semiconductors. The switch transistor 201 and the third control transistor M3 are in a conducting state upon receiving the scan signal Gs at a low voltage level, and in a non-conducting state upon receiving the scan signal Gs at a high-voltage level. The first control transistor M1 and the fourth control transistor M4 are in a conducting state upon receiving the emission signal Es at a low voltage level and in a non-conducting state upon receiving the emission signal Es at a high voltage level. The scan signal Gs and the emission signal Es control the pixel unit 100 to operate in a plurality of time events repeating in sequence.

Figure 6:
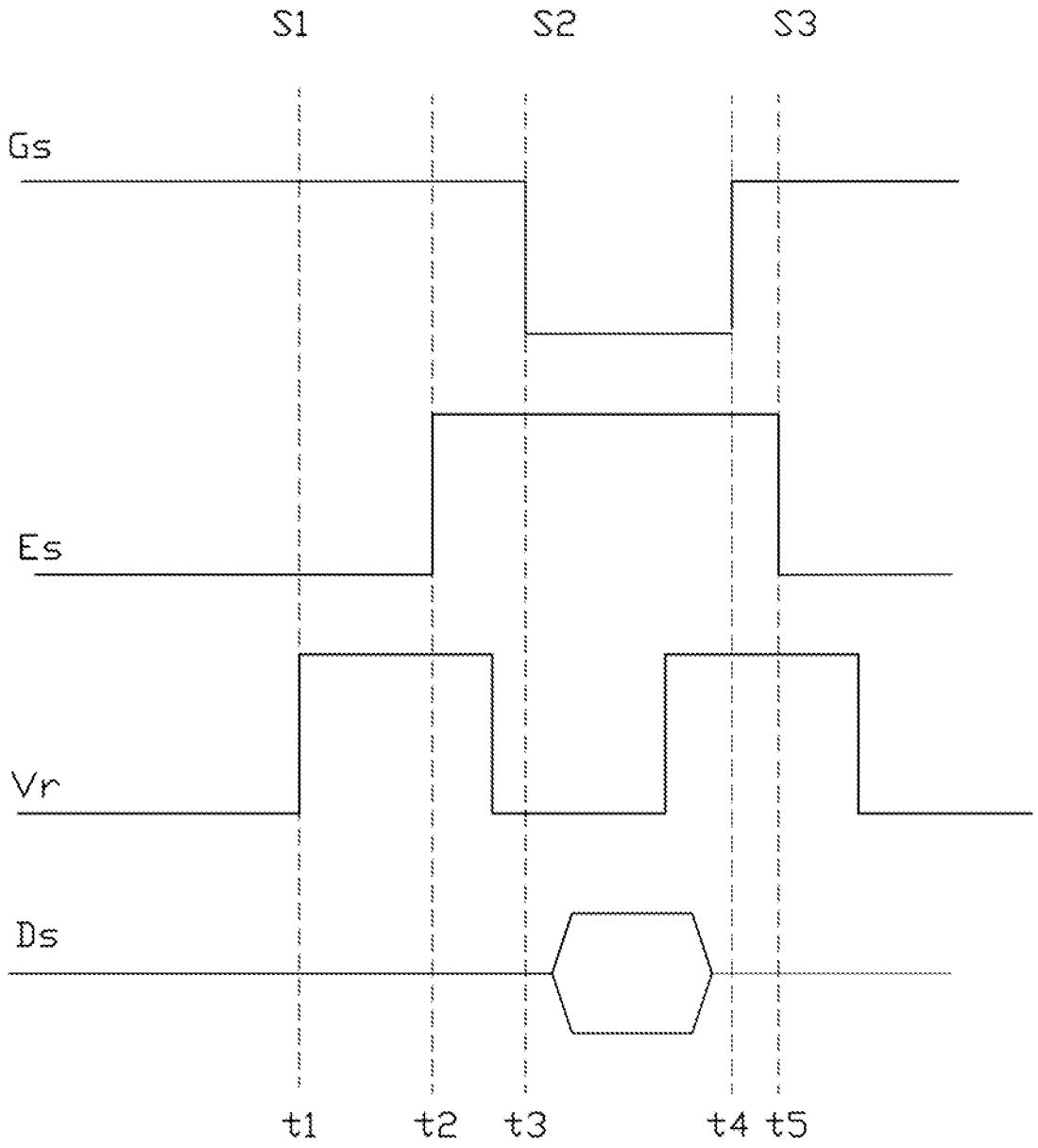
FIG. 6 is a driving sequence diagram of the pixel unit structure of FIG. 5.

As illustrated in FIG. 6, the plurality of time events of each pixel unit 100 can include five time events.

At a first time event t1, the first control transistor M1 is in the conducting state, and the second control transistor M2 is controlled by the driving voltage Vd to be in the conducting state. Thus, a voltage of the first connecting terminal A is different from a voltage of the second connecting terminal B. A time period between the first time event t1 and a second time event t2 is a discharge event. During the discharge event, electric charge in the storage capacitor 202 is discharged through a conduction path formed by the first connecting terminal A and the second connecting terminal B.

At the second time event t2, the first control transistor M1 is controlled by the emission signal Es to be in the non-conducting state.

At a third time event t3, the switch transistor 201 and the third control transistor M3 receive the scan signal Gs at the low voltage level to be in the conducting state. A time period between the third time event t3 and a fourth time event t4 is a data loading event. During the data loading event, the switch transistor 201 receives the data signal Ds and relays the data signal Ds to the first connecting terminal A to make a voltage of the first connecting terminal A equal to a voltage of the data signal Ds (i.e., Vds). The data signal Ds causes the driving transistor 204 to be in the conducting state. A voltage of the second connecting terminal B is equal to the difference between the driving voltage Vd and a threshold voltage Vth of the driving transistor 204, wherein the difference is Vd−Vth. Thus, a voltage difference between the first connecting terminal A and the second connecting terminal B of the storage capacitor 102 is equal to (Vds−(Vd−Vth)). The threshold voltage Vth is equal to the minimum voltage required for the driving transistor 204 to transition from the non-conducting state to the conducting state.

At the fourth time event t4, the switch transistor 201 and the third control transistor M3 are controlled by the scan signal Gs to be in the non-conducting state. Thus, the data signal Ds is stopped from being transmitted to the switch transistor 101.

At a fifth time event t5, the first control transistor M1 and the fourth control transistor M4 are controlled by the emission signal Es to be in the conducting state. A time period between the fifth time event t5 and the first time event t1 is a display event. During the display event, the first control transistor M1 relays the reference voltage Vr to the first connecting terminal A to make the voltage of the first connecting terminal A equal to the reference voltage Vr. The voltage of the second connecting terminal B is equal to (Vr−(Vds−(Vd−Vth))), or (Vr−Vds+Vd−Vth). The driving transistor 204 is controlled by the voltage of the second connecting terminal B to output the driving current Id. The driving current Id is relayed by the fourth control transistor M4 to the OLED 206, and the OLED 206 emits light corresponding to the data signal Ds upon receiving the driving current Id. A current Ie flowing through the OLED 206 is directly proportional to $(Vsg-Vth)^2$, wherein Vsg represents the voltage difference between the source electrode and the gate electrode of the driving transistor 204. Thus, Vsg is equal to (Vd−(Vr−Vds+Vd−Vth), or (−Vr+Vds+Vth). Thus, the current Ie flowing through the OLED 206 is directly proportional to $(Vds-Vr)^2$.

For the first and second embodiments of the electronic display panels 10, 20, the time events t1-t5 repeat in sequence for each pixel unit 100, thereby ensuring accurate storage of the data signals Ds. The current Ie flowing through the OLED 106, 206 is related to the voltage of the data signal Ds and the reference voltage Vr, so the current Ie flowing through the OLED 106, 206 is not fluctuated by the threshold voltage Vth or the driving voltage Vd of the driving transistor 104, 204. Furthermore, the reference voltage Vr supplied by the driving voltage supply driver 160, 260 to different pixel units 100 is the same, so even when the driving voltage Vd supplied to the pixel units 100 fluctuates, an image display quality of the electronic display panels 10, 20 is improved. In addition, the electronic display panel 20 does not require the reset signal generating driver 140 as required by the electronic display panel 10, thereby saving space.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A pixel unit structure of an organic light emitting diode display panel, the pixel unit structure comprising:

a switch transistor configured to receive a scan signal from a scan driver, and the switch transistor configured to receive a data signal from a data driver;

a storage capacitor configured to receive the data signal from the switch transistor;

an organic light emitting diode configured to emit light corresponding to the data signal;

a reset circuit configured to receive an emission signal from an emission signal generating driver, and the reset circuit configured to receive a reference voltage signal from a reference voltage signal generating driver;

a driving transistor configured to output a driving current for driving the organic light emitting diode to emit light; and a control circuit configured to receive the emission signal and relay the driving current from the driving transistor to the organic light emitting diode;

wherein the organic light emitting diode is controlled by the driving transistor and the control circuit to emit light;

wherein the scan signal and the emission signal control the pixel unit to operate in a plurality of time events repeating in sequence; and wherein the storage capacitor comprises a first connecting terminal and a second connecting terminal; the reset circuit comprises a second control transistor; the second control transistor comprises a gate electrode electrically coupled to a driving voltage line to receive a driving voltage from a driving voltage supply driver, a source electrode electrically coupled to the second connecting terminal, and a drain electrode electrically coupled to the gate electrode.

2. The pixel unit structure as in claim 1, wherein:

the organic light emitting diode comprises an anode terminal electrically coupled to the control circuit, and the organic light emitting diode comprises a cathode terminal electrically coupled to ground;

the switch transistor comprises a gate electrode electrically coupled to a scan line to receive the scan signal, a source electrode electrically coupled to a data line to receive the data signal, and a drain electrode electrically coupled to the storage capacitor to relay the data signal to the storage capacitor;

the first connecting terminal electrically coupled to the drain electrode of the switch transistor to receive the data signal, and the second connecting terminal electrically coupled to the driving transistor and the control circuit;

the reset circuit further comprises a first control transistor;

the first control transistor comprises a gate electrode electrically coupled to an emission signal line for receiving the emission signal from the emission signal generating driver, a source electrode electrically coupled to a reference voltage line to receive the reference voltage signal from the reference voltage signal supply driver, and a drain electrode electrically coupled to the first connecting terminal of the storage capacitor;

the driving transistor comprises a gate electrode electrically coupled to the second connecting terminal of the storage capacitor to receive the data signal, a source electrode electrically coupled to the driving voltage line to receive the driving voltage from the driving voltage supply circuit, and a drain electrode electrically coupled to the control circuit;

the data signal controls the driving transistor to be in a conducting state, and the driving transistor in the conducting state is controlled by the driving voltage to output the driving current;

the control circuit comprises a third control transistor and a fourth control transistor;

third control transistor comprises a gate electrode electrically coupled to the scan line to receive the scan signal;

a source electrode of the third control transistor is electrically coupled to the second connecting terminal to receive the data signal;

a drain electrode of the third control transistor is electrically coupled to the fourth control transistor;

the third control transistor is controlled by the scan signal to relay the data signal to the fourth control transistor;

a gate electrode of the fourth control transistor is electrically coupled to the emission signal line to receive the emission signal from the emission signal generating driver;

a source electrode of the fourth control transistor is electrically coupled to the drain electrode of the third control transistor to receive the data signal and receives the driving current; and a drain electrode of the fourth control transistor is electrically coupled to the organic light emitting diode.

3. The pixel unit structure as in claim 2, wherein:

the switch transistor, the driving transistor, the first control transistor, the second control transistor, the third control transistor, and the fourth control transistor are P-channel metal oxide semiconductors;

the switch transistor and the third control transistor are in a conducting state upon receiving the scan signal at a low voltage level, and in a non-conducting state upon receiving the scan signal at a high voltage level;

the first control transistor and the fourth control transistor are in a conducting state upon receiving the emission signal at a low voltage level, and in a non-conducting state upon receiving the emission signal at a high voltage level; and the scan signal and the emission signal control the pixel unit to operate in five time events repeating in sequence.

4. The pixel unit structure as in claim 3, wherein at a first time event:

the first control transistor is in the conducting state;

the second control transistor is controlled by the driving voltage to be in a conducting state;

a voltage of the first connecting terminal is different from a voltage of the second connecting terminal; and electric charge in the storage capacitor is discharged through a conduction path formed by the first connecting terminal and the second connecting terminal.

5. The pixel unit structure as in claim 4, wherein at a second time event, the first control transistor is in the non-conducting state.

6. The pixel unit structure as in claim 5, wherein at a third time event:

the switch transistor is in the conducting state;

the switch transistor in the conducting state receives the data signal;

the data signal is relayed from the switch transistor to the first connecting terminal to make the voltage of the first connecting terminal equal to the voltage of the data signal;

the third control transistor is in the conducting state;

the driving transistor is controlled by the data signal to be in the conducting state; and a voltage of the second connecting terminal is equal to the difference between the driving voltage received by the driving transistor and a threshold voltage of the driving transistor.

7. The pixel unit structure as in claim 6, wherein at a fourth time event, the switch transistor is in the non-conducting state, and the data signal is stopped being transmitted to the switch transistor.

8. The pixel unit structure as in claim 7, wherein at a fifth time event:

the first control transistor is in the conducting state;

the first control transistor in the conducting state relays the reference voltage to the first connecting terminal to make the voltage of the first connecting terminal equal to the reference voltage;

the voltage of the second connecting terminal is equal to the sum of the difference between the reference voltage and the voltage of the data signal and the difference between the driving voltage and the threshold voltage of the driving transistor;

the fourth control transistor is in the conducting state;

the driving transistor is controlled by the voltage of the second connecting terminal to output the driving current;

the fourth driving transistor relays the driving current to the organic light emitting diode;

the organic light emitting diode emits light upon receiving the driving current; and a current passing through the organic light emitting diode is directly proportional to the square of the difference between the voltage of the data signal and the reference voltage.

* * * * *